US010731867B2

(12) United States Patent
Pawar et al.

(10) Patent No.: US 10,731,867 B2
(45) Date of Patent: Aug. 4, 2020

(54) APPLIANCE DRAWER

(71) Applicant: Haier US Appliance Solutions, Inc., Wilmington, DE (US)

(72) Inventors: G. Balaji Pawar, Hyderabad (IN); Anthony Michael Shaw, Chattanooga, TN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 208 days.

(21) Appl. No.: 15/898,697

(22) Filed: Feb. 19, 2018

(65) Prior Publication Data

US 2019/0257527 A1 Aug. 22, 2019

(51) Int. Cl.
*F24C 15/18* (2006.01)
*A47B 88/90* (2017.01)

(52) U.S. Cl.
CPC ..... *F24C 15/18* (2013.01); *A47B 88/90* (2017.01)

(58) Field of Classification Search
CPC ..... F24C 15/00; F24C 15/16; F24C 15/18; A47B 88/90; A47B 88/944; A47B 88/95; A47B 88/956
USPC ..... 312/410, 348.4, 402; 126/273 R
See application file for complete search history.

(56) References Cited

U.S. PATENT DOCUMENTS 2,290,572 A * 7/1942 Rakov ..... F24C 15/18 126/339
2,576,407 A * 11/1951 McDowell ..... F24C 15/16 312/334.19
3,752,553 A 8/1973 Bildahl et al.
4,874,212 A * 10/1989 Rock ..... A47B 88/956 312/330.1
5,597,221 A * 1/1997 Grieser ..... A47B 88/941 312/348.1
7,055,919 B2 * 6/2006 Lam Harn ..... A47B 88/95 312/265.5
9,012,815 B2 4/2015 Cha et al.
2005/0225220 A1 * 10/2005 Huang ..... A47B 88/956 312/348.4
2009/0174299 A1 * 7/2009 Lam ..... A47B 88/956 312/348.4
2011/0265781 A1 * 11/2011 Kim ..... F23D 14/58 126/39 E
2013/0323662 A1 * 12/2013 Bringe ..... F27D 1/00 432/247

FOREIGN PATENT DOCUMENTS

JP 2004-286271 * 10/2004

* cited by examiner

*Primary Examiner* — James O Hansen
(74) *Attorney, Agent, or Firm* — Dority & Manning, P.A.

(57) ABSTRACT

An appliance includes a cabinet, a drawer cavity defined in the cabinet, and a drawer slidably mounted within the drawer cavity. The drawer is slidable between a closed position and an open position. The appliance also includes an outer panel enclosing a front side of the drawer body. A storage volume of the drawer is defined between the drawer body and the outer panel. A first bracket is directly connected to the drawer body at a first side of the drawer body and directly connected to the outer panel at a first side of the outer panel. A second bracket is directly connected to the drawer body at a second side of the drawer body opposite the first side of the drawer body, the second bracket is also directly connected to the outer panel at a second side of the outer panel opposite the first side of the outer panel.

15 Claims, 13 Drawing Sheets

APPLIANCE DRAWER

FIELD OF THE INVENTION

The present subject matter relates generally to storage compartments such as may be used with domestic appliances, for example a storage drawer of an oven appliance, and more particularly to a storage drawer with features for improved ease of assembly and reduced part count.

BACKGROUND OF THE INVENTION

Oven range appliances generally include a cabinet that defines a cooking chamber for baking or broiling food items therein, as well as a cooktop positioned at a top portion of the cabinet for grilling, boiling, or frying food items thereon. To heat the cooking chamber, oven range appliances include heating elements positioned within the cooking chamber, such as at a bottom portion of the cooking chamber and/or at a top portion of the cooking chamber. Oven range appliances additionally include a plurality of mounting features that may extend into the cooking chamber for receiving and holding one or more oven racks during cooking operations. The oven racks can hold food items or cooking utensils within the cooking chamber.

The cabinet can also define a bottom chamber with a drawer positioned therein. The drawer can, in turn, define a compartment that may be used to store one or more cooking utensils or other cooking accessories for the oven range appliance.

Conventionally, such drawers include at least a drawer body, a liner which extends across the full width of the drawer body, an outer panel, and a pair of wedges provided in the front, lower corners of the drawer body. The foregoing parts of the drawer require a significant amount of time to assemble into the final drawer product. For example, multiple screws may be used to fasten various parts together, which requires an increased part count as well as significant labor effort and time to assemble the drawer. Additionally, several of the parts may require specialized techniques and equipment for assembly, for example, the drawer liner is typically press-joined to the drawer body.

Accordingly, a storage drawer of an oven appliance with features for improved ease of assembly and reduced part count would be useful.

BRIEF DESCRIPTION OF THE INVENTION

The present invention provides a drawer, which may be a storage drawer for an appliance such as an oven appliance, with a drawer body and an outer panel. The drawer body and the outer panel are connected by a pair of brackets. The brackets each include a liner member, a spacer member, and a wedge member all of which are constructed of a single, seamless, unitary piece. Additional aspects and advantages of the invention will be set forth in part in the following description, or may be apparent from the description, or may be learned through practice of the invention.

In one exemplary embodiment, an oven appliance is provided. The oven appliance defines a vertical direction, a lateral direction and a transverse direction that are mutually perpendicular to one another. The oven appliance includes a cabinet extending between a top side and a bottom side along the vertical direction, between a left side and a right side along the lateral direction, and between a front side and a rear side along the transverse direction. A cooking chamber is defined in the cabinet and configured for receipt of items to be cooked. A drawer cavity is defined in the cabinet below the cooking chamber along the vertical direction. The oven appliance also includes a drawer configured to be slidably mounted within the drawer cavity. As such, the drawer is slidable along the transverse direction between a closed position and an open position. The drawer includes a drawer body received within the drawer cavity when the drawer is in the closed position and extending outside of the drawer cavity when the drawer is in the open position. The drawer also includes an outer panel enclosing a front side of the drawer body and a storage volume defined between the drawer body and the outer panel. The outer panel is positioned outside the drawer cavity when the drawer is in the closed position. The drawer also includes a first bracket directly connected to the drawer body at a left side of the drawer and directly connected to the outer panel at the left side of the drawer and a second bracket directly connected to the drawer body at a right side of the drawer opposite the left side of the drawer along the lateral direction. The second bracket is directly connected to the outer panel at the right side of the drawer.

In another exemplary embodiment, a drawer of an appliance is provided. The appliance includes a cabinet and a drawer cavity defined in the cabinet. The drawer defines a vertical direction, a lateral direction and a transverse direction that are mutually perpendicular to one another. The drawer is configured to be slidably mounted within the drawer cavity such that the drawer is slidable along the transverse direction between a closed position and an open position. The drawer includes a drawer body that is received within the drawer cavity when the drawer is in the closed position and that extends outside of the drawer cavity when the drawer is in the open position. The drawer also includes an outer panel enclosing a front side of the drawer body and a storage volume defined between the drawer body and the outer panel. The outer panel is positioned outside the drawer cavity when the drawer is in the closed position. The drawer further includes a first bracket directly connected to the drawer body at a left side of the drawer and directly connected to the outer panel at the left side of the drawer and a second bracket directly connected to the drawer body at a right side of the drawer opposite the left side of the drawer along the lateral direction. The second bracket is directly connected to the outer panel at the right side of the drawer.

In yet another exemplary embodiment, an appliance is provided. The appliance includes a cabinet, a drawer cavity defined in the cabinet, and a drawer configured to be slidably mounted within the drawer cavity. When the drawer is mounted within the drawer cavity, the drawer is slidable between a closed position wherein a drawer body of the drawer is received within the drawer cavity and an open position wherein the drawer body extends outside of the drawer cavity. The appliance also includes an outer panel enclosing a front side of the drawer body. A storage volume of the drawer is defined between the drawer body and the outer panel. The outer panel is positioned outside the drawer cavity when the drawer body is in the closed position. A first bracket is directly connected to the drawer body at a first side of the drawer body and directly connected to the outer panel at a first side of the outer panel. A second bracket is directly connected to the drawer body at a second side of the drawer body opposite the first side of the drawer body, the second bracket is also directly connected to the outer panel at a second side of the outer panel opposite the first side of the outer panel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
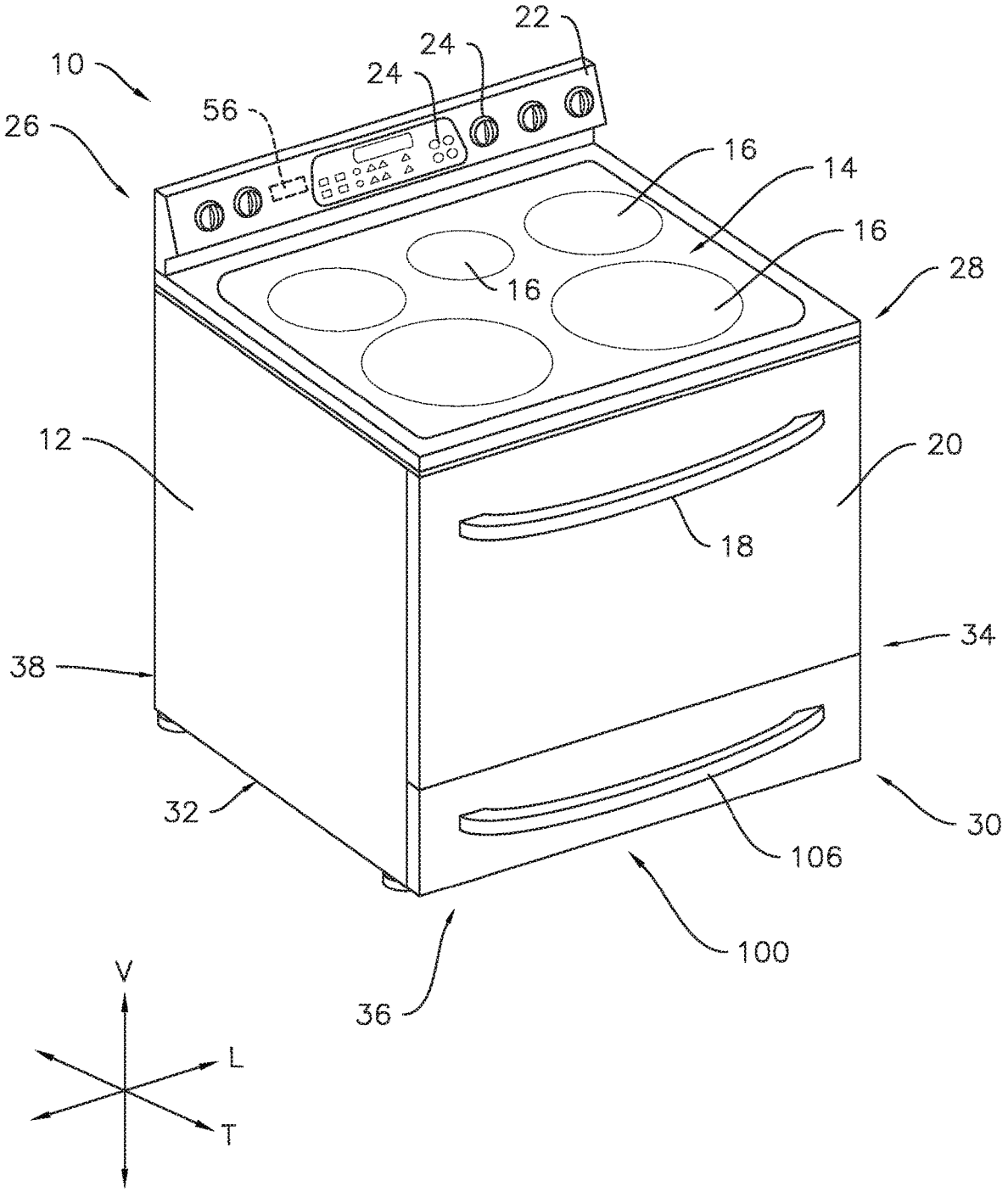
FIG. 1 provides a perspective view of an appliance according to one or more embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees either clockwise or counterclockwise with the vertical direction V.

FIG. 1 provides a perspective view of an oven appliance 10 according to an exemplary embodiment of the present subject matter. As may be seen, e.g., in FIG. 1, oven appliance 10 defines a vertical direction V, a lateral direction L and a transverse direction T. The vertical direction V, the lateral direction L and the transverse direction T are mutually perpendicular and form an orthogonal direction system. Oven appliance 10 is provided by way of example only and is not intended to limit the present subject matter to the arrangement shown in FIG. 1. Thus, the present subject matter may be used with other oven appliance configurations, e.g., double oven appliances, oven appliances having differently arranged burners, etc.

Figure 2:
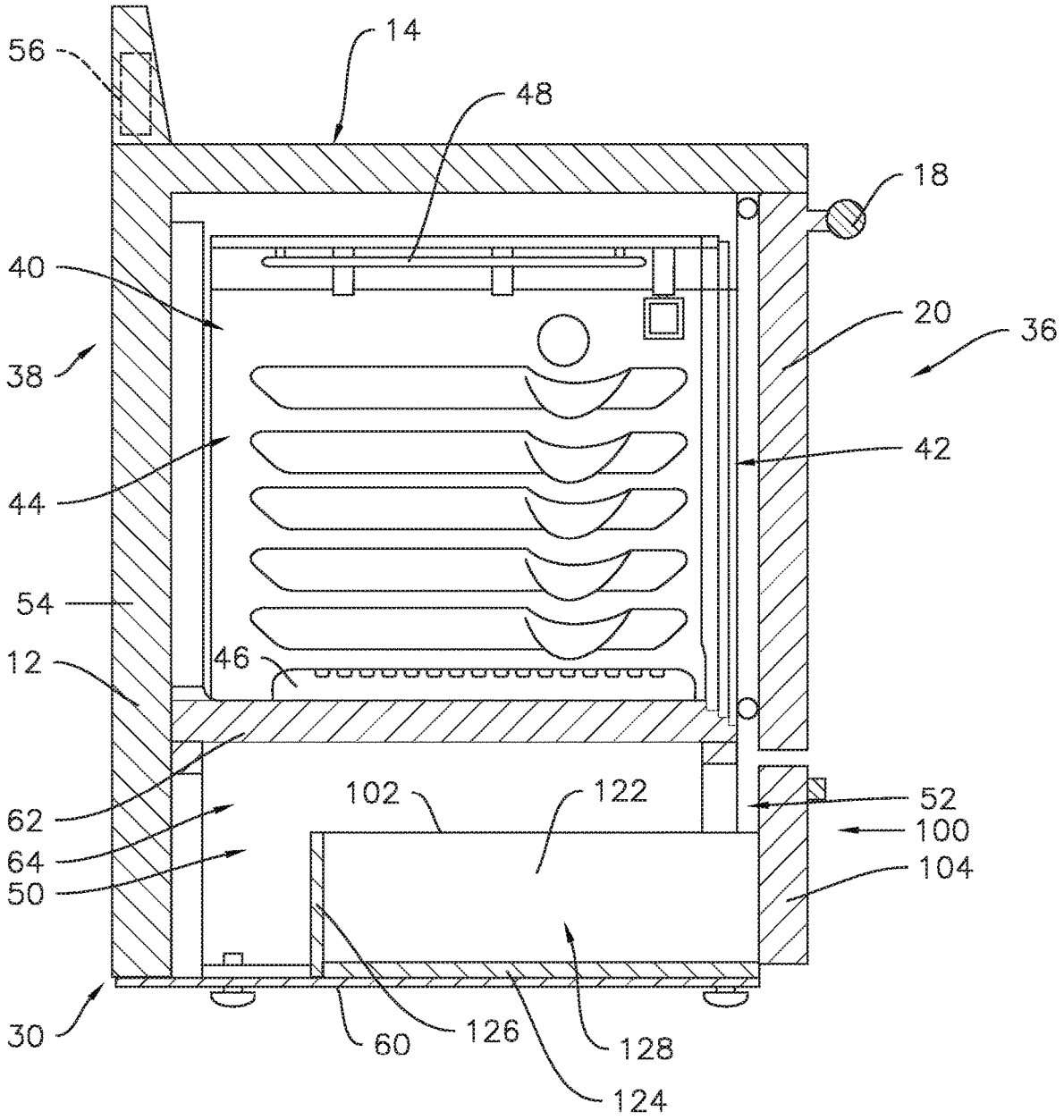
FIG. 2 provides a side section view of the appliance of FIG. 1 with a drawer of the appliance in a closed position.

As seen, e.g., in FIGS. 1 and 2, the oven appliance includes a housing or cabinet 12. The cabinet 12 extends between a top 28 and a bottom 30 along the vertical direction V, between a left side 32 and a right side 34 along the lateral direction L, and between a front portion 36 and a back portion 38 along the transverse direction T.

A cooking surface 14 may be provided at or near the top portion 28 of cabinet 12. The cooking surface 14 includes a plurality of heating elements 16. For the embodiment depicted, the oven appliance 10 includes five heating elements 16 spaced along cooking surface 14. The heating elements 16 are generally electric heating elements. In certain exemplary embodiments, oven appliance 10 may be an induction cooktop appliance with induction heating elements or coils mounted below cooking surface 14. However, in other embodiments, the oven appliance 10 may include any other suitable shape, configuration, and/or number of heating elements 16. Additionally, in other embodiments, the oven appliance 10 may include any other suitable type of heating element 16, such as a resistance heating element. Each of the heating elements 16 may be the same type of heating element 16, or oven appliance 10 may include a combination of different types of heating elements 16.

Oven appliance 10 also includes a door 20 that permits access to a cooking chamber 40 (FIG. 2) defined within the cabinet 12 of oven appliance 10, e.g., for cooking or baking of food items therein. A handle 18 is mounted to door 20 and assists a user with opening and closing door 20. A control panel 22 having controls 24 permits a user to make selections for cooking of food items. The control panel 22 may be positioned on a backsplash 26 of oven appliance 10. Controls 24 may include buttons, knobs, and the like, as well as combinations thereof. As an example, a user may manipulate one or more controls 24 to select a temperature and/or a heat or power output for each heating element 16.

Figure 3:
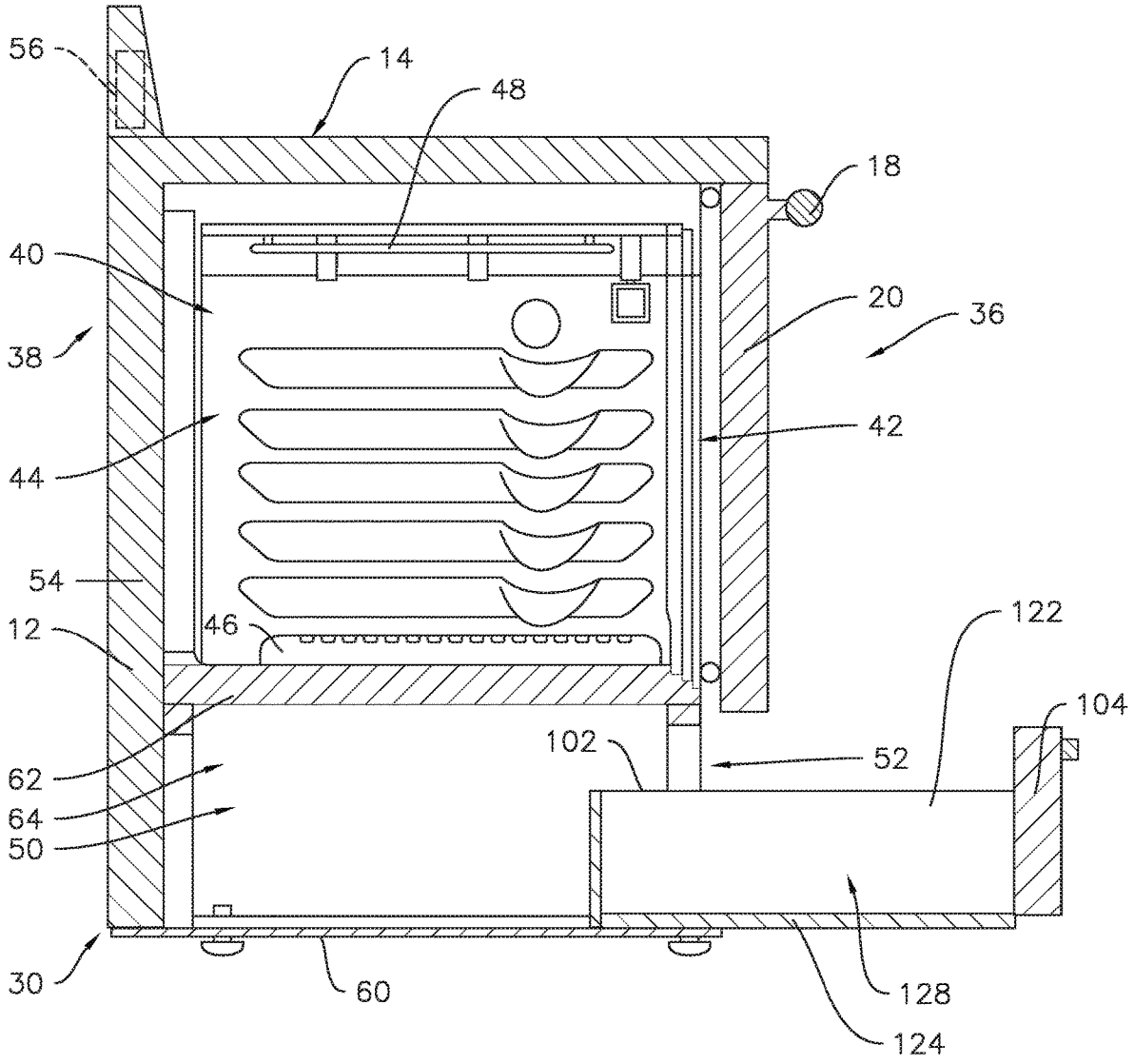
FIG. 3 provides a side section view of the appliance of FIG. 1 with a drawer of the appliance in an open position.

FIG. 2 provides a side, section view of oven appliance 10 with a storage drawer 100 in a closed position. FIG. 3 provides a similar view as FIG. 2 with the drawer 100 in an open position. Cabinet 12 defines an interior cooking chamber 40 and a cooking chamber opening 42. Cooking chamber 40 is defined by an interior surface 44 of cabinet 12 and is configured for the receipt of one or more food items to be cooked. Cooking chamber opening 40 is positioned at front portion 36 of cabinet 12 and permits access to cooking chamber 40 of cabinet 12. Oven range appliance 10 also includes a cooking chamber door 20 rotatably mounted to cabinet 12, e.g., with a hinge (not shown). Cooking chamber door 20 of the cooking chamber 40 is positioned at or adjacent to opening 42 of cabinet 12 and is selectively moveable between an open position (not shown) and a closed position (FIGS. 1 through 3). With cooking chamber door 20 in the open position, a user can access cooking chamber 40 of cabinet 12 through opening 42 of cabinet 12. Conversely, cooking chamber door 20 hinders or prevents access to cooking chamber 40 of cabinet 12 through opening 42 of cabinet 12 when cooking chamber door 20 is in the closed position. A handle 18 is mounted to cooking chamber door 20 and assists a user with shifting cooking chamber door 20 between the open and closed positions in order to access cooking chamber 40. For example, a user can pull on handle 18 to adjust cooking chamber door 20 from the closed position to the open position and access cooking chamber 40.

A bake or bottom heating element 46 is positioned in cabinet 12, e.g., at a bottom end of the cooking chamber 40. Bottom heating element 46 is used to heat cooking chamber 40 for both cooking and cleaning of oven range appliance 10. The size and heat output of bottom heating element 46 can be selected based on the e.g., the size of oven range appliance 10. Bottom heating element 46 can be any suitable heating element. For example, bottom heating element 40 may be an electric resistance heating element, a gas burner, a microwave heating element, etc.

A broil or top heating element 48 is also positioned in cooking chamber 40 of cabinet 12, e.g., at a top end of the cooking chamber 40. Top heating element 48 is used to heat cooking chamber 40 for both cooking/broiling and cleaning of oven range appliance 10. Like bottom heating element 46, the size and heat output of top heating element 48 can be selected based on e.g., the size of oven range appliance 10. Top heating element 48 can be any suitable heating element. For example, top heating element 48 may be an electric resistance heating element, a gas burner, a microwave heating element, etc.

The oven appliance 10 may include a controller 56 operably connected to the control panel 22 and controls 24. The controller 56 may be operably connected to each of the heating elements, including the plurality of heating element 16 on the cooktop surface 14 and the top and bottom heating elements 46 and 48 in the cooking chamber 40, for controlling a power level of each of the heating elements in response to one or more user inputs received through the control panel 22 and controls 24. The controls 24 may be configured in wired or wireless communication with the controller 56. Signals generated in controller 56 operate appliance 10 in response to user input via the controls 24.

The controller 56 may generally include a computing device having one or more processor(s) and associated memory device(s). The computing device may be configured to perform a variety of computer-implemented functions to control the exemplary oven appliance 10. The computing device can include a general purpose computer or a special purpose computer, or any other suitable computing device. It should be appreciated, that as used herein, the processor may refer to a controller, a microcontroller, a microcomputer, a programmable logic controller (PLC), an application specific integrated circuit, and other programmable circuits. Additionally, the memory device(s) may generally comprise memory element(s) including, but not limited to, computer readable medium (e.g., random access memory (RAM)), computer readable non-volatile medium (e.g., a flash memory), a compact disc-read only memory (CD-ROM), a magneto-optical disk (MOD), a digital versatile disc (DVD), and/or other suitable memory elements. The memory can store information accessible by processor (s), including instructions that can be executed by processor (s). For example, the instructions can be software or any set of instructions that when executed by the processor(s), cause the processor(s) to perform operations. The instructions may include a software package configured to operate the oven appliance 10.

The cabinet 12 further defines a drawer cavity 50 positioned below the cooking chamber 14 along the vertical direction V and a drawer cavity opening 52 at the front portion 36 of the cabinet 12. More particularly, the cabinet 12 includes a rear wall 54, a bottom plate 60, and a ceiling 62 defining the drawer cavity 50. The ceiling 62 is positioned at a top side 64 the drawer cavity 50 and may in certain exemplary embodiments be referred to as an insulation retainer plate for an insulation layer (not shown) positioned between the drawer cavity 50 and the cooking chamber 40. However, in other exemplary embodiments, the ceiling 62 may instead be any other wall or panel positioned at a top side of the drawer cavity 50.

Drawer 100 may be positioned at least partially in the drawer cavity 50. For example, the drawer 100 may be slidably mounted within the drawer cavity such that the drawer 100 is movable, e.g., slidable, along the transverse direction T between an open position (FIG. 3), in which at least a portion of the drawer 100 is extended outwardly along the transverse direction T through the drawer cavity opening 52, and a closed position (FIG. 2) in which a drawer body 102 of the drawer 100 is positioned entirely within the drawer cavity 50.

Figure 4:
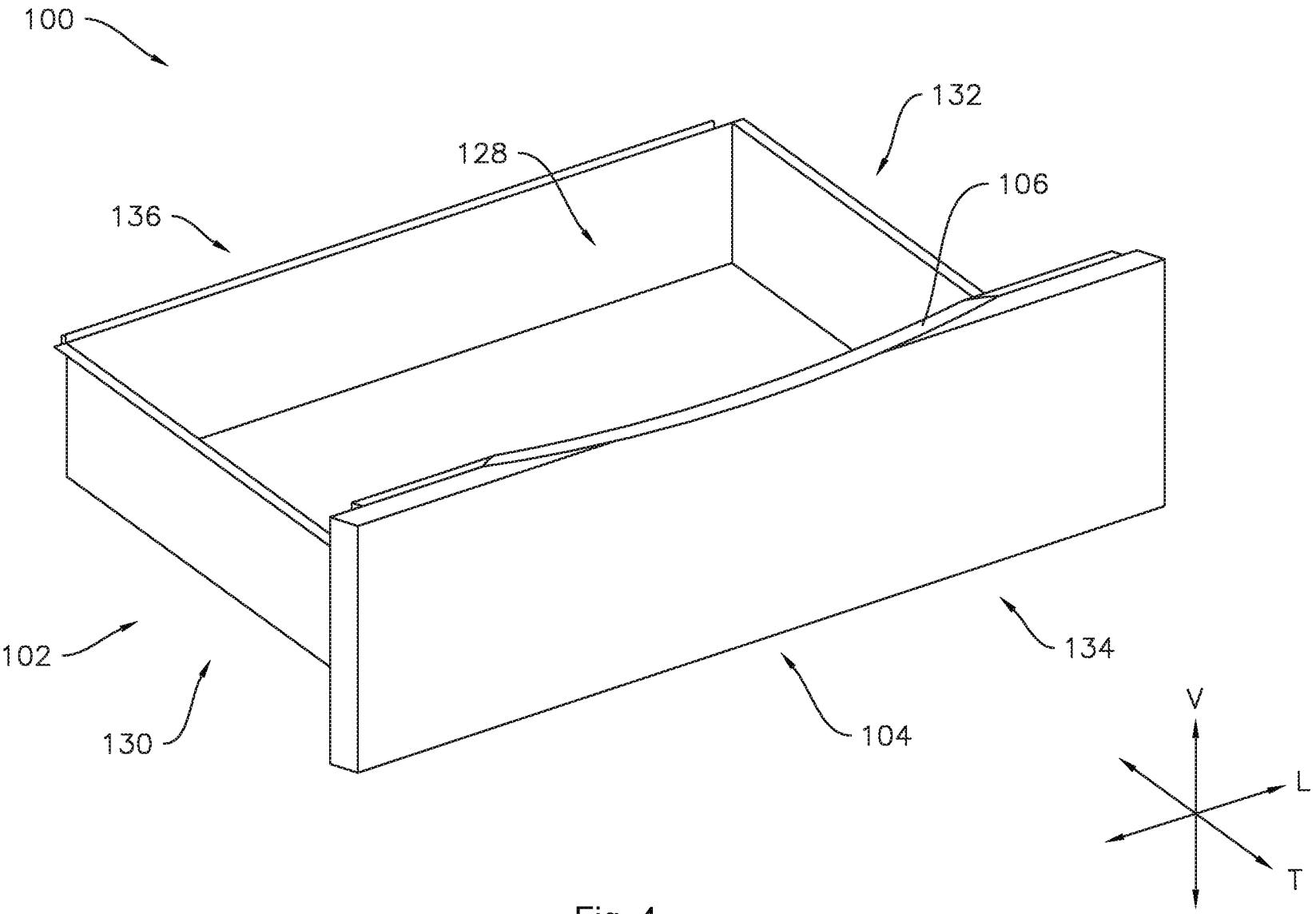
FIG. 4 provides a perspective view of a drawer according to one or more embodiments of the present subject matter.

As shown in FIG. 4, the drawer 100 defines a vertical direction V, a lateral direction L, and a transverse direction T that are mutually perpendicular to one another. The drawer 100 includes a drawer body 102 and an outer panel 104 connected to the drawer body 102. As described in more detail below, the outer panel 104 may be connected to the drawer body 102 by a first bracket 200 and a second bracket 300. The outer panel 104 generally defines a front of the drawer 100 and fits over the drawer cavity opening 52 to cover the drawer cavity opening 52 when the drawer 100 is in the closed position, thus, the outer panel 104 is positioned outside the drawer cavity 50 when the drawer 100 is in the closed position. Additionally, a handle 106 may be provided to assist a user in moving the drawer 100 between the open and closed positions. In some embodiments, for example as illustrated in FIGS. 1-3, the handle 106 may be provided as a separate component. In other exemplary embodiments, e.g., as illustrated in FIG. 4, the handle 106 may instead be integrated into the outer panel 104, e.g., the outer panel 104 may define a pocket that acts as the handle 106.

Figure 5:
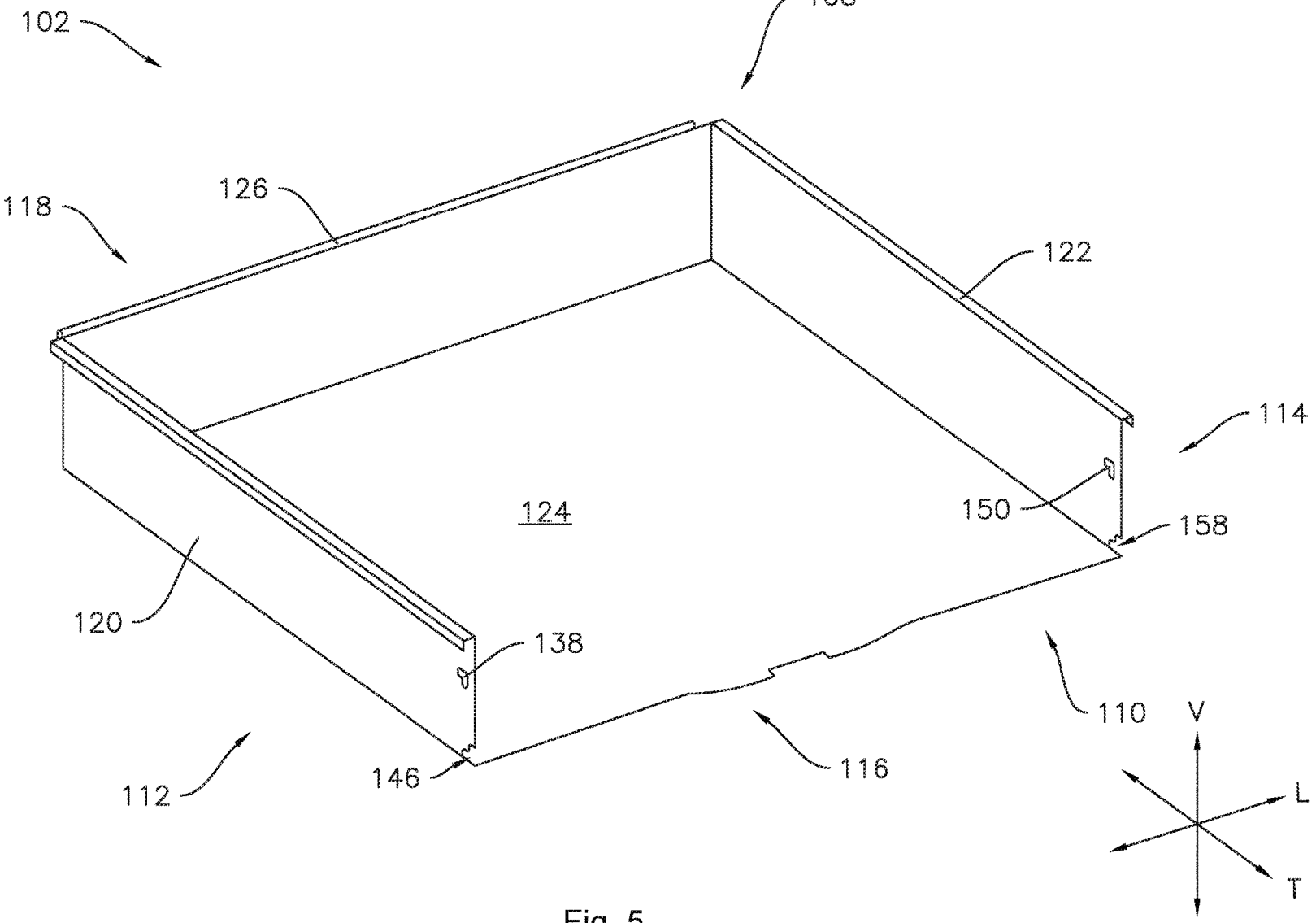
FIG. 5 provides a perspective view of a drawer body according to one or more embodiments of the present subject matter.

The drawer body 102 may be received entirely within the drawer cavity 50 when the drawer 100 is in the closed position (FIG. 2) and the drawer body 102 may extend at least partially outside of the drawer cavity 50 when the drawer 100 is in the open position (FIG. 3). As illustrated for example in FIG. 5, the drawer body 102 may extend between a top 108 and a bottom 110 along the vertical direction V, between a left side 112 and a right side 114 along the lateral direction L, and between a front 116 and a rear 118 along the transverse direction T. Additionally, the drawer body 102 may include a left side wall 120 which extends along the left side 112 of the drawer body 102 between the front 116 and the rear 118 of the drawer body 102 and a right side wall 122 opposite the left side wall 120, the right side wall 122 may extend between the front 116 and the rear 118 of the drawer body 102 along the right side 114 of the drawer body 102. The drawer body 102 may further include a rear wall 126 extending along the rear 118 of the drawer body 102 between the left side wall 120 and the right side wall 122 and a floor 124 which extends along the lateral direction L and the transverse direction T between the left side wall 120, the right side wall 122, and the rear wall 126. As illustrated in FIG. 5, the drawer body 102 may be open at the front 116. Accordingly, as illustrated in FIG. 4, the outer panel 104, when connected to the drawer body 102, encloses the front side 116 of the drawer body 102 such that a storage volume is defined between the drawer body 102 and the outer panel 104. In particular embodiments, the left and right side walls 120 and 122, floor 124, rear wall 126, and outer panel 104 may define the storage volume 128. The storage volume 128 may be used to store, e.g., cooking utensils and/or cooking accessories.

Figure 6:
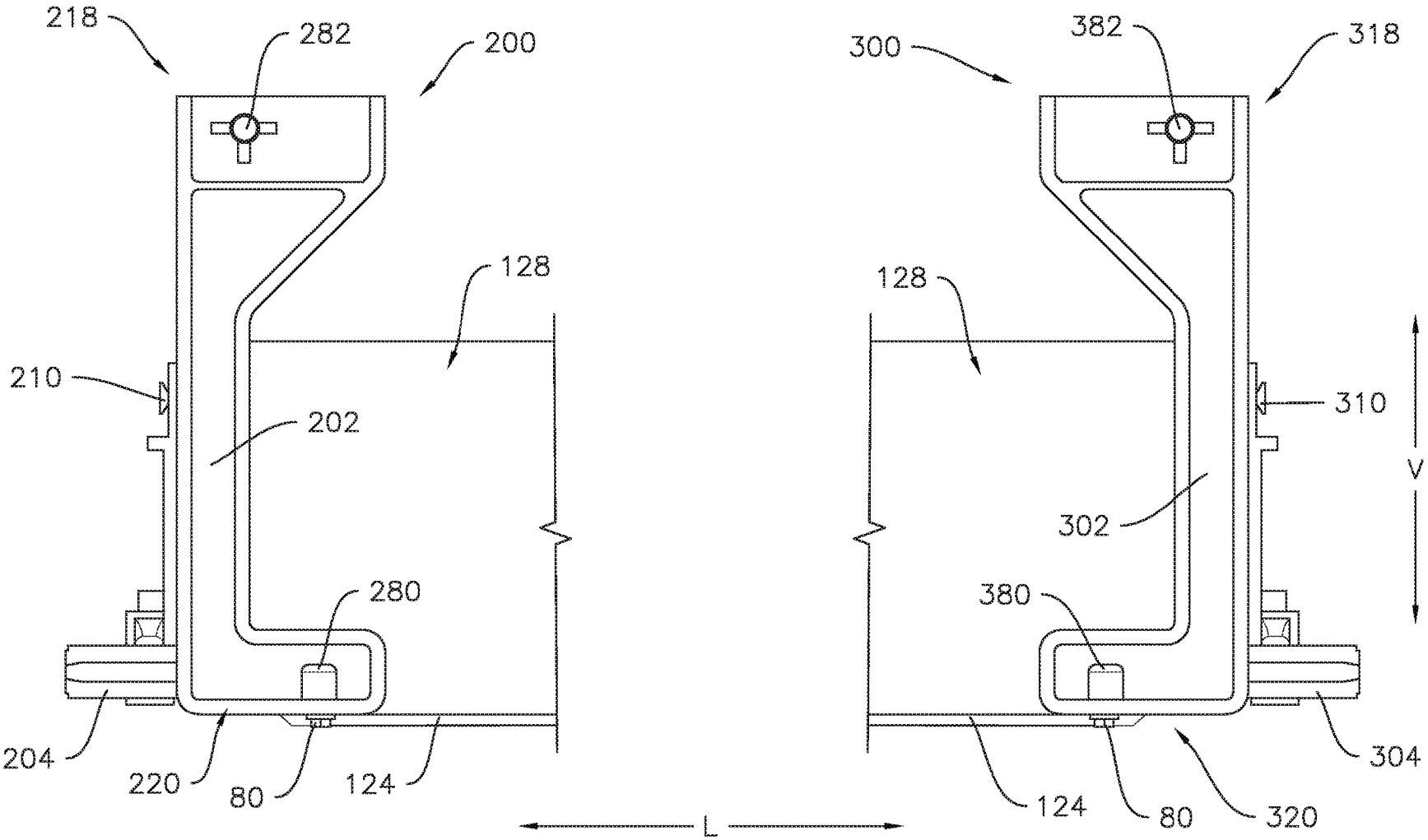
FIG. 6 provides a front view of a drawer body with first and second brackets connected thereto according to one or more embodiments of the present subject matter.
Figure 7:
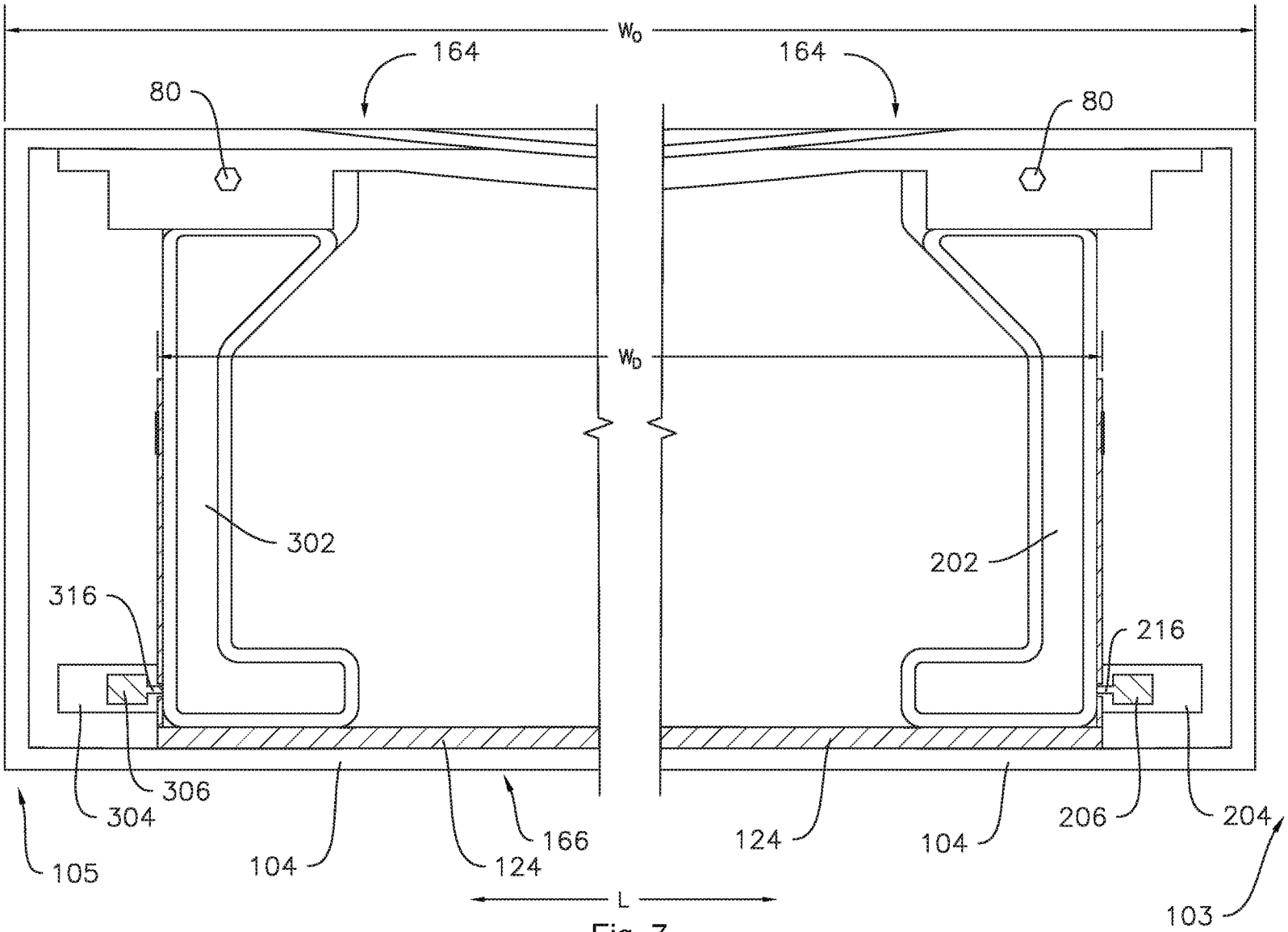
FIG. 7 provides a back view of an outer panel of a drawer, with first and second brackets partially sectioned and a drawer body shown in section, according to one or more embodiments of the present subject matter.

As mentioned above, the drawer body 102 and the outer panel 104 may be connected by first and second brackets 200 and 300. FIG. 6 provide a front view of the drawer body 102 with first and second brackets 200 and 300 connected to the drawer body 102. The outer panel 104 is not shown in FIG. 6. As illustrated in FIG. 6, the first bracket 200 may be directly connected to the drawer body 102 at a left side 130 of the drawer 100 and the second bracket 300 may be directly connected to the drawer body 102 at a right side of the drawer 132 opposite the left side 130 of the drawer 100 along the lateral direction L. For example, the first and second bracket 200 and 300 may be directly connected to the drawer body 102 with fasteners, e.g., screws 80. The screws 80 may be received in a vertically oriented internally threaded port 280 on the first bracket 200 and a vertically oriented internally threaded port 380 on the second bracket 300. The first bracket 200 may also include a horizontally oriented internally threaded port 282 and the second bracket 300 may include a horizontally oriented internally threaded port 282, each for connecting to the outer panel 104 via additional screws 80 (FIG. 7). FIG. 7 provides a back view of the outer panel 104, with first and second brackets 200 and 300 directly connected to the outer panel 104 and shown partially in section, and the drawer body 102 is shown in section in FIG. 7. As illustrated in FIG. 7, the first bracket 200 may be directly connected to the outer panel 104 at the left side 130 of the drawer 100, and the second bracket 300 may be directly connected to the outer panel 104 at the right side 132 of the drawer 100. In each of FIGS. 6 and 7, the middle portion of the drawer 100 is omitted for clarity.

As may be seen in FIG. 6, the first bracket 200 may include a liner member 202 positioned within the storage volume 128 of the drawer 100. Also as may be seen in FIG. 6, the first bracket 200 may further include a spacer member 204 extending away from the drawer body 102 along the lateral direction L outside the storage volume 128 of the drawer 100. Similarly, the second bracket 300 may include a liner member 302 positioned within the storage volume 128 of the drawer 100 and a spacer member 304 extending away from the drawer body 102 along the lateral direction L outside the storage volume 128 of the drawer 100. The liner members 202 and 302 do not extend across the entire width $W_D$ of the drawer body 102, as shown, the liner members 202 and 302 extend only partially along the width $W_D$ of the drawer body 102. As may be seen in FIG. 7, the first bracket 200 may include a wedge member 206 extending along the left side 130 of the drawer 100 outside the storage volume 128 of the drawer 100 and the second bracket 300 may include a wedge member 306 extending along the right side 132 of the drawer 100 outside the storage volume 128 of the drawer 100. As may be seen in FIGS. 10 and 11, the wedge member 206 of the first bracket 200 may include a chamfered portion 208. As may be seen in FIG. 16, the wedge member 306 of the second bracket 300 may include a chamfered portion 308. The first bracket 200 may advantageously be provided as a one-piece unitary construction including the liner member 202, the spacer member 204, and the wedge member 206. Likewise, the second bracket 300 may advantageously be provided as a one-piece unitary construction including the liner member 302, the spacer member 304, and the wedge member 306. Unitary brackets 200 and 300 may advantageously provide a drawer 100 with a reduced part count which is consequently easier and cheaper to assemble.

As illustrated for example in FIG. 6, the first bracket 200 may extend between a bottom 220 and a top 218 along the vertical direction V. In the installed position, the bottom 220 of the first bracket 200 is proximate the floor 124 of the drawer body 102, as shown for example in FIG. 6, and the top 218 of the first bracket 200 is positioned above the drawer body 102 along the vertical direction V and proximate a top 164 of the outer panel 104, as shown for example in FIG. 7. Similarly, the second bracket 300 extends between a bottom 320 and a top 318 along the vertical direction V with the bottom 320 of the second bracket 300 proximate the floor 124 of the drawer body 102 in the installed position, as shown for example in FIG. 6. As may be seen, e.g., in FIG. 7, the top 318 of the second bracket 300 is positioned above the drawer body 102 along the vertical direction V and proximate the top 164 of the outer panel 104.

Referring again to FIG. 7, the outer panel 104 extends from a left side 103 to a right side 105 along the lateral direction L and from a top 164 to a bottom 166 along the vertical direction V. The outer panel 104 defines a width $W_O$ from the left side 103 to the right side 105. As noted above, the drawer body 102 extends between the left side 112 and the right side 114 along the lateral direction L. As shown in FIG. 7, the drawer body 102 defines a width $W_D$ from the left side 112 to the right side 114 and the width $W_O$ of the outer panel 104 is greater than the width $W_D$ of the drawer body 102. In some embodiments, the spacer member 204 of the first bracket 200 may extend between the left side 112 of the drawer body 102 and the left side 103 of the outer panel 104 along the lateral direction L, and the spacer member 304 of the second bracket 300 may extend between the right side 114 of the drawer body 102 and the right side 105 of the outer panel 104 along the lateral direction L.

Figure 9:
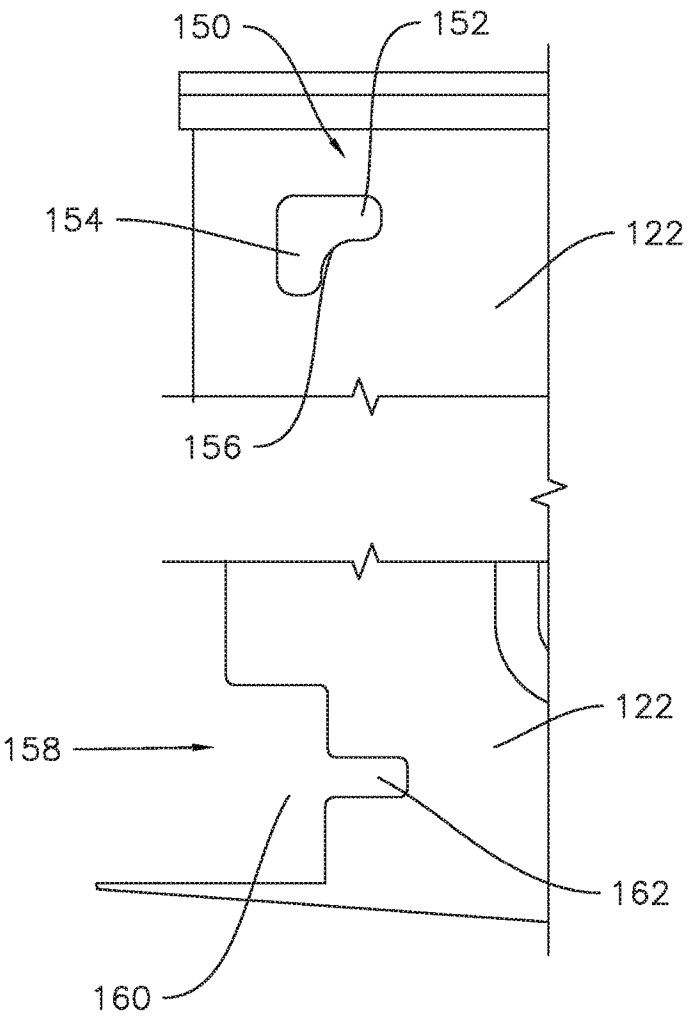
FIG. 9 provides an enlarged partial right side view of a drawer body according to one or more embodiments of the present subject matter.
Figure 8:
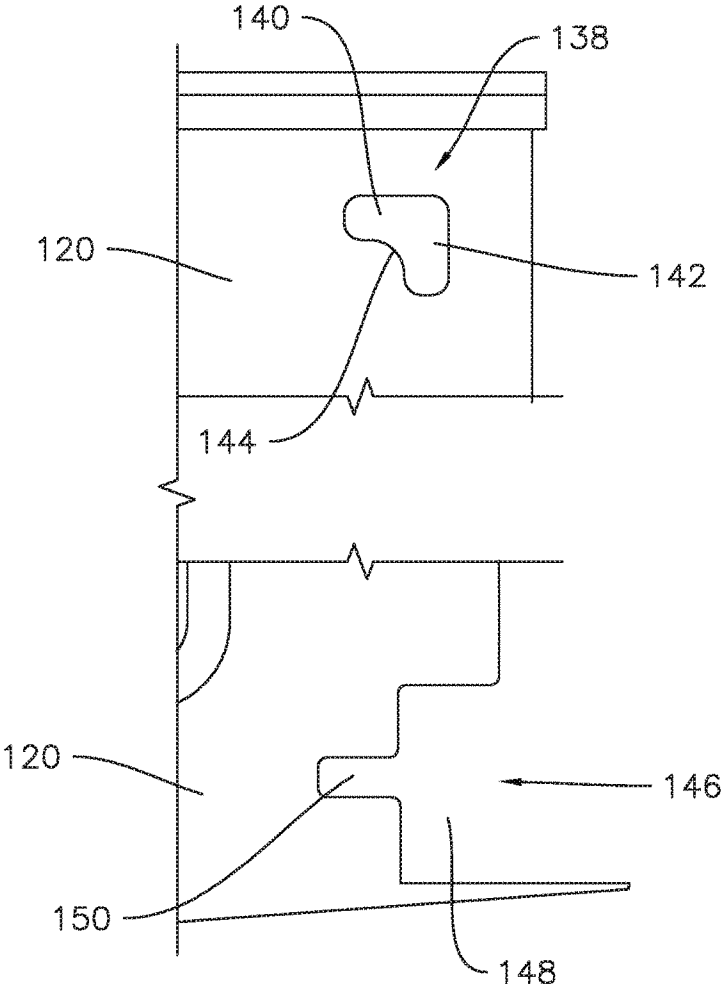
FIG. 8 provides an enlarged partial left side view of a drawer body according to one or more embodiments of the present subject matter.

As shown in FIGS. 8 and 9, the drawer 100 may include a left slot 138 formed in the left side wall 120 of the drawer body 102 and a right slot 150 formed in the right side wall 122 of the drawer body 102. As illustrated for example in FIG. 8, the left slot 138 may include a first leg 140 and a second leg 142 with an arcuate track 144 extending between the first leg 140 and the second leg 142. The first leg and the second leg 142 are generally orthogonal to one another. For example, the first leg 140 may extend generally along the transverse direction T and the second leg 142 may extend generally along the vertical direction V. Also shown in FIG. 8 is a left notch 146 formed in the left side wall 120 of the drawer body 102. The left notch 146 may include a front portion 148 which extends to the floor 124 of the drawer body 102 and a rear portion 150. As illustrated for example in FIG. 9, the right slot 150 may include a first leg 152 and a second leg 154 generally orthogonal to the first leg 152 with an arcuate track 156 extending between the first leg 152 and the second leg 154. For example, the first leg 152 of the right slot 150 may extend generally along the transverse direction T and the second leg 154 of the right slot 150 may extend generally along the vertical direction V. Also shown in FIG. 9 is a right notch 158 formed in the right side wall 122 of the drawer body 102. The right notch 158 may include a front portion 160 which extends to the floor 124 of the drawer body 102 and a rear portion 162.

Figure 10:
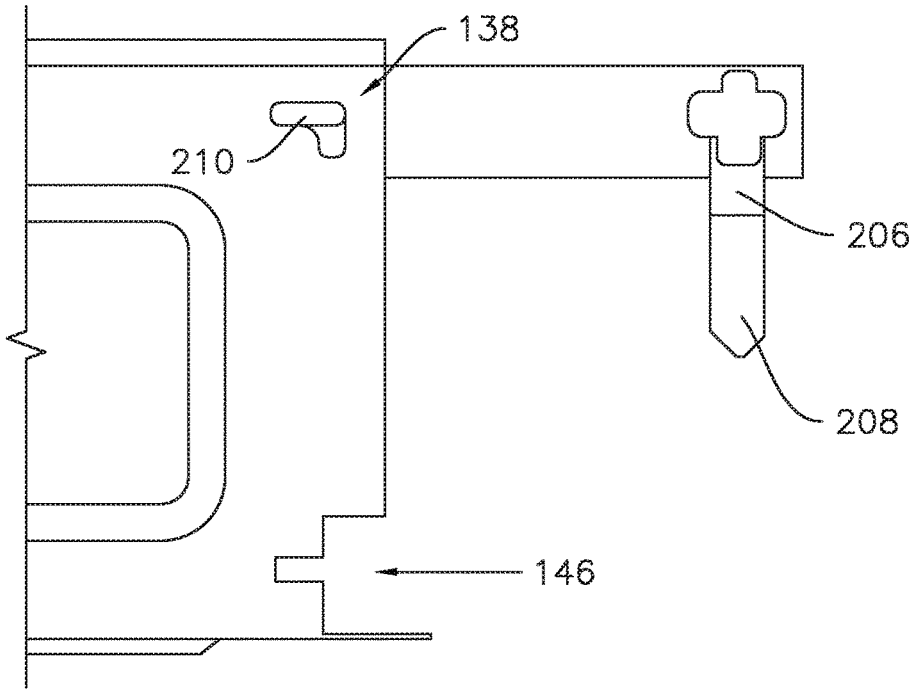
FIG. 10 provides a left side view of a drawer body and a first bracket according to one or more embodiments of the present subject matter, with the first bracket in a transverse position.
Figure 11:
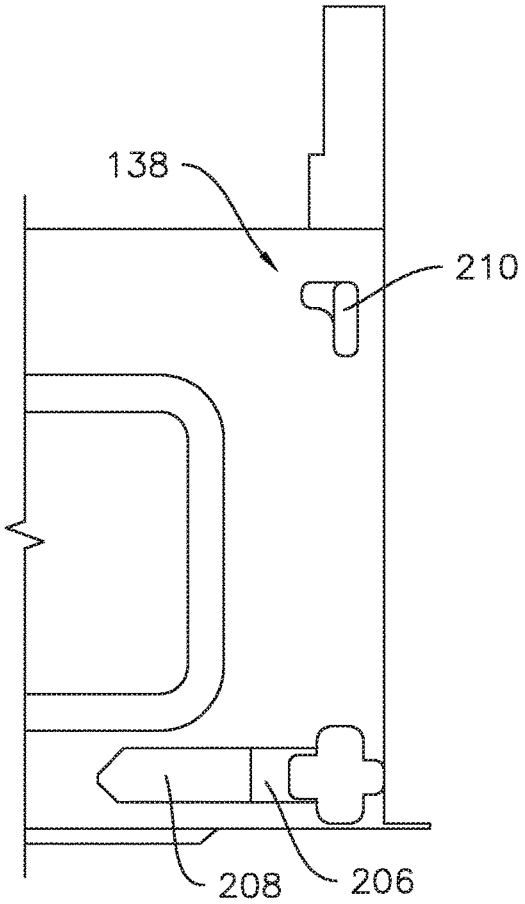
FIG. 11 provides a view of the drawer body and first bracket of FIG. 10, with the first bracket in a vertical position.
Figure 15:
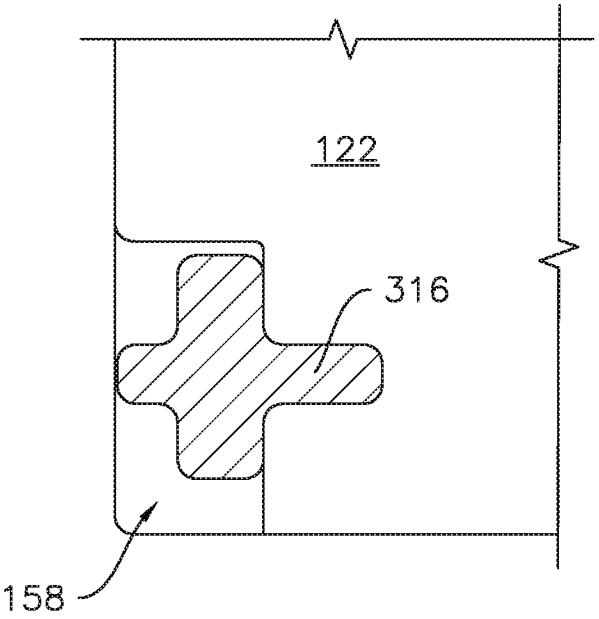
FIG. 15 provides an enlarged view of a portion of a drawer body and a second bracket according to one or more embodiments of the present subject matter.
Figure 16:
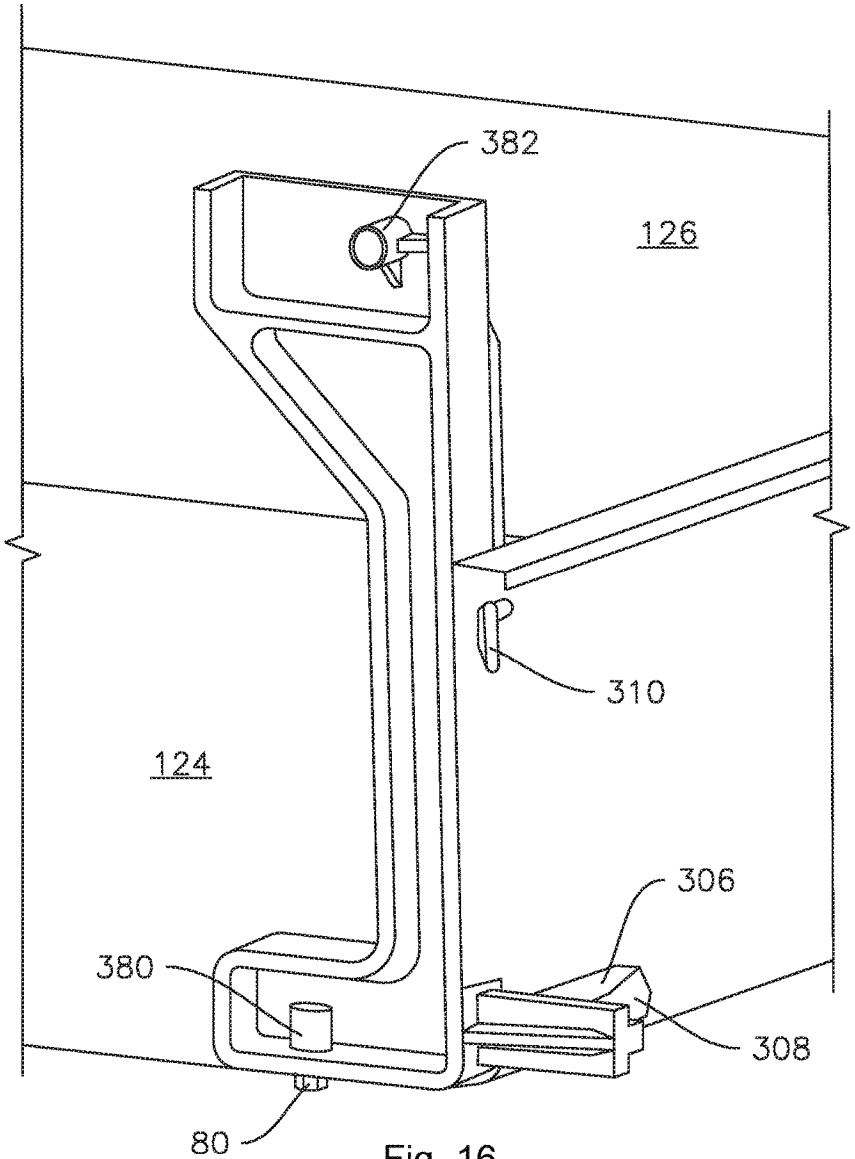
FIG. 16 provides a perspective view of a second bracket and an associated portion of a drawer body according to one or more embodiments of the present subject matter.

As illustrated for example in FIG. 11, the first bracket 200 may include a first tab 210 received within the left slot 138 of the drawer body 102 and a second tab 216 (FIG. 14) received within the left notch 146 of the drawer body 102. As shown in FIGS. 8, 10, and 11, the left slot 138 may be positioned above the left notch 146 along the vertical direction V. As generally shown in FIG. 16, the second bracket 300 may include a third tab 310 received within the right slot 150 of the drawer body 102 and a fourth tab 316 (FIGS. 7 and 15) received within the right notch 158 of the drawer body 102, with the right slot 150 positioned above the right notch 158 along the vertical direction V, as may be seen in FIGS. 9 and 16. As best shown in FIG. 7, the second tab 216 may extend inwards towards the drawer body 102 along the lateral direction L from the wedge member 206 of the first bracket 200 and the fourth tab 316 may extend inwards towards the drawer body 102 along the lateral direction L from the wedge member 306 of the second bracket 300.

Figure 13:
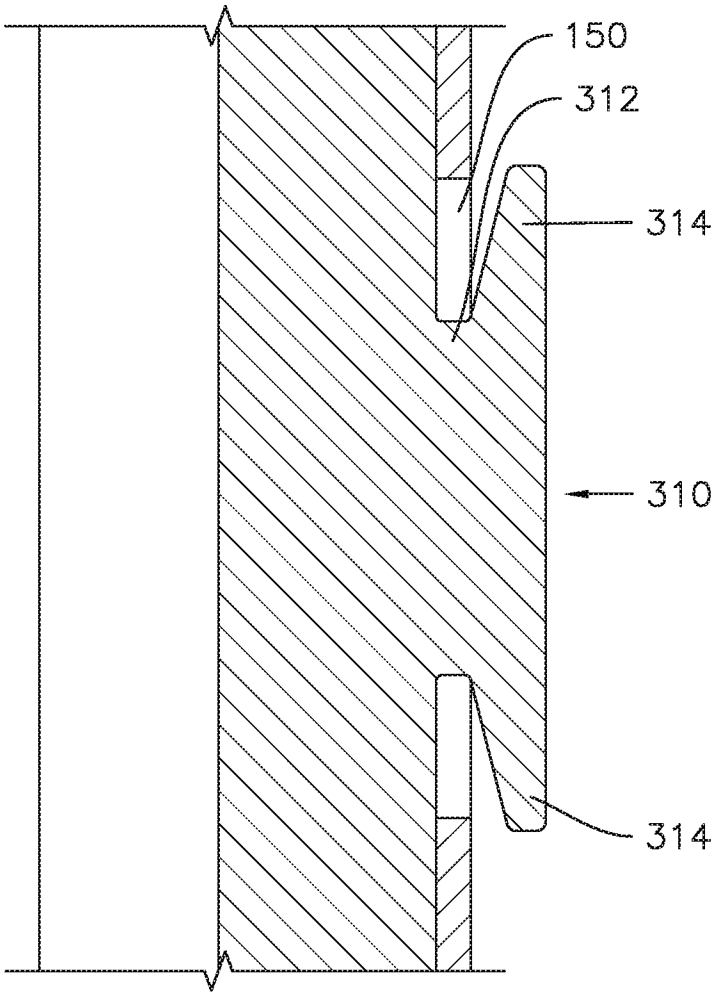
FIG. 13 provides an enlarged section view of a portion of a drawer body and a second bracket according to one or more embodiments of the present subject matter.
Figure 12:
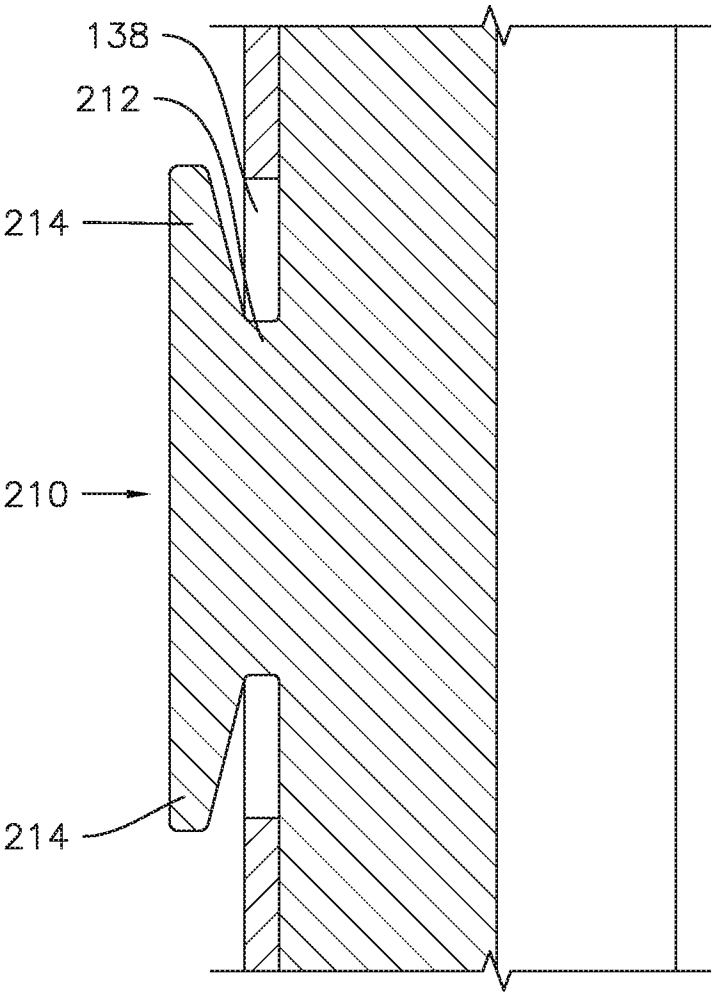
FIG. 12 provides an enlarged section view of a portion of a drawer body and a first bracket according to one or more embodiments of the present subject matter.
Figure 14:
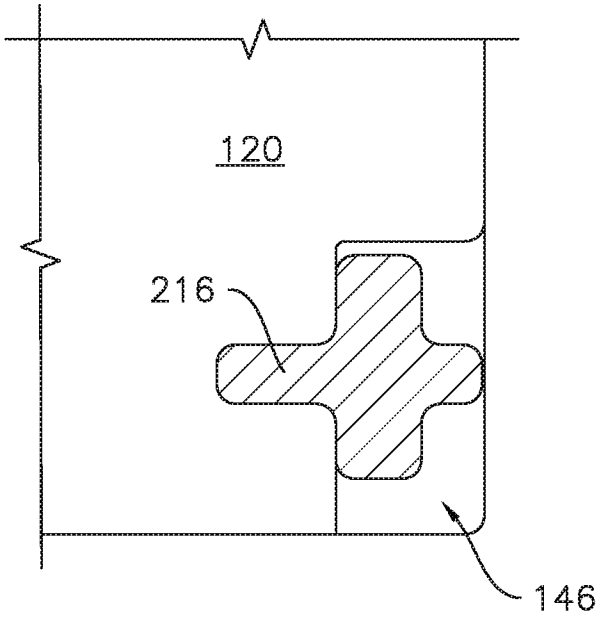
FIG. 14 provides an enlarged view of a portion of a drawer body and a first bracket according to one or more embodiments of the present subject matter.

As shown in FIG. 12, the first tab 210 may include a neck portion 212 extending through the left slot 138 and a pair of wings 214 positioned outside the storage volume 128 (FIG. 6). The pair of wings 214 of the first tab 210 may be configured to pass through the first leg 140 of the left slot 138 when the first bracket 200 is in a transverse position, as shown in FIG. 10, and the first bracket 200 may be rotatable from the transverse position of FIG. 10 to a vertical position, as shown for example in FIG. 11. The first tab 210 may be movable within the left slot 138 from the first leg 140 to the second leg 142 when the first bracket 200 rotates from the transverse position to the vertical position. As shown in FIG. 13, the third tab 310 may include a neck portion 312 extending through the right slot 150 and a pair of wings 314 positioned outside the storage volume 128 (FIG. 6). The pair of wings 314 of the third tab 310 may be configured to pass through the first leg 152 of the right slot 150 when the second bracket 300 is in a transverse position, the second bracket 300 may be rotatable from the transverse position to a vertical position, and the third tab 310 may be movable within the right slot 150 from the first leg 152 to the second leg 154 when the second bracket 300 rotates from the transverse position to the vertical position. The transverse position of the bracket may also be considered a start position, and assembly of each bracket 200, 300 to the drawer body 104 may be easily started by placing the first tab 210 and second tab 310 through each respective slot 138 and 150. Further, upon rotation from the transverse start position to the final vertical position, each bracket may be at least partially locked in place without fasteners via an interference fit or close fit between each bracket and the respective side of the drawer body 104, in particular between tabs 216 and 316 and respective notches 146 and 158, as shown in FIGS. 14 and 15.

Figure 17:
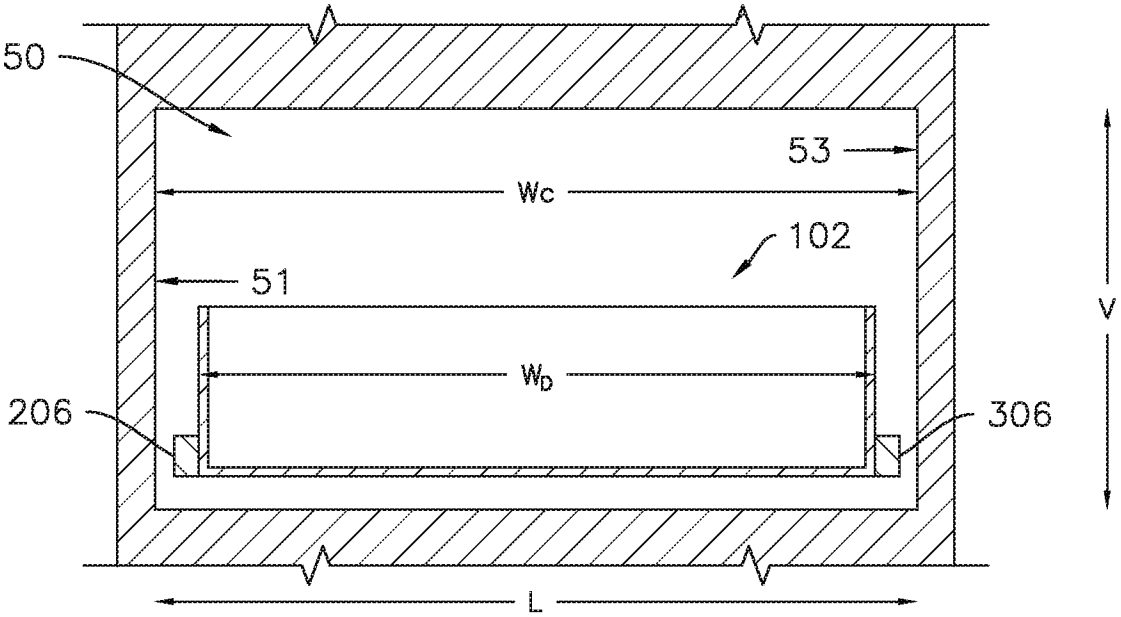
FIG. 17 provides a front section view of a drawer cavity and a drawer body received therein according to one or more embodiments of the present subject matter.

As illustrated for example in FIG. 17, the drawer cavity 50 extends from a left side 51 to a right side 53 along the lateral direction L, such that the drawer cavity 50 defines a width $W_C$ from the left side 51 to the right side 53. As mentioned above, the drawer body defines a width $W_D$. As shown in FIG. 17, the width We of the drawer cavity 50 is greater than the width $W_D$ of the drawer body 102. Accordingly, the wedge members 206 and 306 of the first and second brackets 200 and 300 may be disposed between the drawer body 102 and the drawer cavity 50 when the drawer 100 is in the closed position. In particular, the chamfered portions 208 and 308 of the wedge members 206 and 306 may advantageously promote centering and alignment of the drawer body 102 within the drawer cavity 50 when the drawer 100 translates generally along the transverse direction T from the open position to the closed position. The chamfered portion 208 of the wedge member 206 of the first bracket 200 may engage the left side 51 of the drawer cavity 50 if the drawer body 102 is off center to the left when the drawer 100 translates generally along the transverse direction T from the open position to the closed position. Similarly, the chamfered portion 308 of the wedge member 306 of the second bracket 300 may engage the right side 53 of the drawer cavity 50 if the drawer body 102 is off center to the right when the drawer 100 translates generally along the transverse direction T from the open position to the closed position. In either case, the chamfered portion 208 or 308 may guide the drawer body back towards the center of the drawer cavity, which may advantageously promote easier movement of the drawer 100 into the closed position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance defining a vertical direction, a lateral direction and a transverse direction that are mutually perpendicular to one another, the oven appliance comprising:

a cabinet extending between a top side and a bottom side along the vertical direction, between a left side and a right side along the lateral direction, and between a front side and a rear side along the transverse direction;

a cooking chamber defined in the cabinet and configured for receipt of items to be cooked;

a drawer cavity defined in the cabinet below the cooking chamber along the vertical direction;

a drawer configured to be slidably mounted within the drawer cavity, whereby the drawer is slidable along the transverse direction between a closed position and an open position, the drawer comprising:

a drawer body received within the drawer cavity when the drawer is in the closed position and extending outside of the drawer cavity when the drawer is in the open position;

an outer panel enclosing a front side of the drawer body, a storage volume of the drawer defined between the drawer body and the outer panel, the outer panel positioned outside the drawer cavity when the drawer is in the closed position;

a first bracket directly connected to the drawer body at a left side of the drawer and directly connected to the outer panel at the left side of the drawer; and a second bracket directly connected to the drawer body at a right side of the drawer opposite the left side of the drawer along the lateral direction, the second bracket directly connected to the outer panel at the right side of the drawer;

wherein the first bracket comprises a first tab received within a left slot of the drawer body and a second tab received within a left notch of the drawer body, the left slot positioned above the left notch along the vertical direction, and the second bracket comprises a third tab received within a right slot of the drawer body and a fourth tab received within a right notch of the drawer body, the right slot positioned above the right notch along the vertical direction;

wherein the first tab comprises a neck portion extending through the left slot and a pair of wings positioned outside the storage volume of the drawer, the left slot comprising a first leg oriented along the transverse direction, a second leg oriented along the vertical direction, and an arcuate track connecting the first leg and the second leg, the pair of wings of the first tab configured to pass through the first leg of the left slot when the first bracket is in a transverse position, the first bracket rotatable from the transverse position to a vertical position, the first tab movable within the left slot from the first leg to the second leg when the first bracket rotates from the transverse position to the vertical position, and wherein the third tab comprises a neck portion extending through the right slot and a pair of wings positioned outside the storage volume of the drawer, the right slot comprising a first leg oriented along the transverse direction, a second leg oriented along the vertical direction, and an arcuate track connecting the first leg and the second leg, the pair of wings of the third tab configured to pass through the first leg of the right slot when the second bracket is in a transverse position, the second bracket rotatable from the transverse position to a vertical position, the third tab movable within the right slot from the first leg to the second leg when the second bracket rotates from the transverse position to the vertical position.

2. The oven appliance of claim 1, wherein the first bracket comprises a liner member positioned within the storage volume of the drawer, a spacer member extending away from the drawer body along the lateral direction outside the storage volume of the drawer and a wedge member extending along the left side of the drawer body outside the storage volume of the drawer, and wherein the second bracket comprises a liner member positioned within the storage volume of the drawer, a spacer member extending away from the drawer body along the lateral direction outside the storage volume of the drawer and a wedge member extending along the right side of the drawer body outside the storage volume of the drawer.

3. The oven appliance of claim 1, wherein the outer panel of the drawer extends from a left side to a right side along the lateral direction, the outer panel defining a width from the left side to the right side, wherein the drawer body extends from a left side to a right side along the lateral direction, the drawer body defining a width from the left side to the right side, the width of the outer panel greater than the width of the drawer body, the first bracket comprising a spacer member extending between the left side of the drawer body and the left side of the outer panel along the lateral direction, and the second bracket comprising a spacer member extending between the right side of the drawer body and the right side of the outer panel along the lateral direction.

4. The oven appliance of claim 1, wherein the drawer cavity extends from a left side to a right side along the lateral direction, the drawer cavity defining a width from the left side to the right side, wherein the drawer body extends from a left side to a right side along the lateral direction, the drawer body defining a width from the left side to the right side, the width of the drawer cavity greater than the width of the drawer body, the first bracket comprising a wedge member extending along the left side of the drawer body outside the storage volume of the drawer, the wedge member of the first bracket comprising a chamfered portion oriented towards the rear side of the cabinet, and the second bracket comprising a wedge member extending along the right side of the drawer body outside the storage volume of the drawer, the wedge member of the second bracket comprising a chamfered portion oriented towards the rear side of the cabinet.

5. The oven appliance of claim 1, wherein the drawer body comprises a floor, wherein the first bracket extends between a bottom and a top along the vertical direction, the bottom of the first bracket proximate the floor of the drawer body, the top of the first bracket positioned above the drawer body along the vertical direction and proximate a top of the outer panel, and wherein the second bracket extends between a bottom and a top along the vertical direction, the bottom of the second bracket proximate the floor of the drawer body, the top of the second bracket positioned above the drawer body along the vertical direction and proximate the top of the outer panel.

6. A drawer of an appliance, the appliance comprising a cabinet and a drawer cavity defined in the cabinet, the drawer defining a vertical direction, a lateral direction and a transverse direction that are mutually perpendicular to one another, the drawer configured to be slidably mounted within the drawer cavity, whereby the drawer is slidable along the transverse direction between a closed position and an open position, the drawer comprising:

a drawer body received within the drawer cavity when the drawer is in the closed position and extending outside of the drawer cavity when the drawer is in the open position;

an outer panel enclosing a front side of the drawer body, a storage volume defined between the drawer body and the outer panel, the outer panel positioned outside the drawer cavity when the drawer is in the closed position;

a first bracket directly connected to the drawer body at a left side of the drawer and directly connected to the outer panel at the left side of the drawer; and a second bracket directly connected to the drawer body at a right side of the drawer opposite the left side of the drawer along the lateral direction, the second bracket directly connected to the outer panel at the right side of the drawer;

wherein the first bracket comprises a first tab received within a left slot of the drawer body and a second tab received within a left notch of the drawer body, the left slot positioned above the left notch along the vertical direction, and the second bracket comprises a third tab received within a right slot of the drawer body and a fourth tab received within a right notch of the drawer body, the right slot positioned above the right notch along the vertical direction;

wherein the first tab comprises a neck portion extending through the left slot and a pair of wings positioned outside the storage volume, the left slot comprising a first leg oriented along the transverse direction, a second leg oriented along the vertical direction, and an arcuate track connecting the first leg and the second leg, the pair of wings of the first tab configured to pass through the first leg of the left slot when the first bracket is in a transverse position, the first bracket rotatable from the transverse position to a vertical position, the first tab movable within the left slot from the first leg to the second leg when the first bracket rotates from the transverse position to the vertical position, and wherein the third tab comprises a neck portion extending through the right slot and a pair of wings positioned outside the storage volume, the right slot comprising a first leg oriented along the transverse direction, a second leg oriented along the vertical direction, and an arcuate track connecting the first leg and the second leg, the pair of wings of the third tab configured to pass through the first leg of the right slot when the second bracket is in a transverse position, the second bracket rotatable from the transverse position to a vertical position, the third tab movable within the right slot from the first leg to the second leg when the second bracket rotates from the transverse position to the vertical position.

7. The drawer of claim 6, wherein the first bracket comprises a liner member positioned within the storage volume of the drawer, a spacer member extending away from the drawer body along the lateral direction outside the storage volume of the drawer and a wedge member extending along the left side of the drawer body outside the storage volume of the drawer, and wherein the second bracket comprises a liner member positioned within the storage volume of the drawer, a spacer member extending away from the drawer body along the lateral direction outside the storage volume of the drawer and a wedge member extending along the right side of the drawer body outside the storage volume of the drawer.

8. The drawer of claim 6, wherein the outer panel extends from a left side to a right side along the lateral direction, the outer panel defining a width from the left side to the right side, wherein the drawer body extends from a left side to a right side along the lateral direction, the drawer body defining a width from the left side to the right side, the width of the outer panel greater than the width of the drawer body, the first bracket comprising a spacer member extending between the left side of the drawer body and the left side of the outer panel along the lateral direction, and the second bracket comprising a spacer member extending between the right side of the drawer body and the right side of the outer panel along the lateral direction.

9. The drawer of claim 6, wherein the first bracket comprises a wedge member extending along the transverse direction outside the storage volume, the wedge member of the first bracket comprising a chamfered portion, and the second bracket comprises a wedge member extending along the transverse direction outside the storage volume, the wedge member of the second bracket comprising a chamfered portion.

10. The drawer of claim 6, wherein the drawer body comprises a floor, wherein the first bracket extends between a bottom and a top along the vertical direction, the bottom of the first bracket proximate the floor of the drawer body, the top of the first bracket positioned above the drawer body along the vertical direction and proximate a top of the outer panel, and wherein the second bracket extends between a bottom and a top along the vertical direction, the bottom of the second bracket proximate the floor of the drawer body, the top of the second bracket positioned above the drawer body along the vertical direction and proximate the top of the outer panel.

11. An appliance, comprising:

a cabinet;

a drawer cavity defined in the cabinet;

a drawer configured to be slidably mounted within the drawer cavity, whereby the drawer is slidable between a closed position wherein a drawer body of the drawer is received within the drawer cavity and an open position wherein the drawer body extends outside of the drawer cavity;

an outer panel enclosing a front side of the drawer body, a storage volume of the drawer defined between the drawer body and the outer panel, the outer panel positioned outside the drawer cavity when the drawer body is in the closed position;

a first bracket directly connected to the drawer body at a first side of the drawer body and directly connected to the outer panel at a first side of the outer panel, the first bracket comprising a first tab received within a left slot of the drawer body and a second tab received within a left notch of the drawer body, the left slot positioned above the left notch; and a second bracket directly connected to the drawer body at a second side of the drawer body opposite the first side of the drawer body, the second bracket directly connected to the outer panel at a second side of the outer panel opposite the first side of the outer panel, the second bracket comprising a third tab received within a right slot of the drawer body and a fourth tab received within a right notch of the drawer body, the right slot positioned above the right notch;

wherein the first tab comprises a neck portion extending through the left slot and a pair of wings positioned outside the storage volume, the left slot comprising a first leg, a second leg oriented perpendicular to the first leg, and an arcuate track connecting the first leg and the second leg, the pair of wings of the first tab configured to pass through the first leg of the left slot when the first bracket is in a start position, the first bracket rotatable from the start position to an installed position, the first tab movable within the left slot from the first leg to the second leg when the first bracket rotates from the start position to the installed position, and wherein the third tab comprises a neck portion extending through the right slot and a pair of wings positioned outside the storage volume, the right slot comprising a first leg, a second leg oriented perpendicular to the first leg, and an arcuate track connecting the first leg and the second leg, the pair of wings of the third tab configured to pass through the first leg of the right slot when the second bracket is in a start position, the second bracket rotatable from the start position to an installed position, the third tab movable within the right slot from the first leg to the second leg when the second bracket rotates from the start position to the installed position.

12. The appliance of claim 11, wherein the drawer body comprises a floor, a bottom of the first bracket aligned with the floor of the of the drawer body, a bottom of the second bracket aligned with the floor of the drawer body, the first bracket extending generally perpendicular to the floor of the drawer body from the bottom of the first bracket to a top of the first bracket positioned above the drawer body, and the second bracket extending generally perpendicular to the floor of the drawer body from the bottom of the second bracket to a top of the second bracket positioned above the drawer body.

13. The appliance of claim 11, wherein the drawer body comprises a left side wall and a right side wall opposite the left side wall, the first bracket directly connected to the left side wall of the drawer body and the second bracket directly connected to the right side wall of the drawer body.

14. The appliance of claim 11, wherein the first bracket comprises a liner member positioned within the storage volume of the drawer, a spacer member extending away from the drawer body outside the storage volume of the drawer and a wedge member extending along the first side of the drawer body outside the storage volume of the drawer, and wherein the second bracket comprises a liner member positioned within the storage volume of the drawer, a spacer member extending away from the drawer body outside the storage volume of the drawer and a wedge member extending along the second side of the drawer body outside the storage volume of the drawer.

15. The appliance of claim 14, wherein the wedge member of the first bracket comprises a chamfered portion oriented away from the outer panel and the wedge member of the second bracket comprises a chamfered portion oriented away from the outer panel.

* * * * *